United States Patent [19]

Kiapos et al.

[11] Patent Number: 4,988,542

[45] Date of Patent: Jan. 29, 1991

[54] METHOD FOR FABRICATING DECORATIVE BEAD CHAINS

[76] Inventors: John Kiapos; Dennis Lotz, both of 9161 La Tuna Canyon Rd., Sun Valley, Calif. 91352

[21] Appl. No.: 476,937

[22] Filed: Feb. 8, 1990

Related U.S. Application Data

[62] Division of Ser. No. 425,129, Oct. 23, 1989.

[51] Int. Cl.[5] ..... B05D 3/02; B05D 3/12; B05D 5/00

[52] U.S. Cl. ..... 427/172; 427/171; 427/262; 427/280; 427/287; 427/293

[58] Field of Search ..... 63/2, 4; 427/262, 258, 427/265, 267, 280, 287, 171, 172, 293

[56] References Cited

U.S. PATENT DOCUMENTS

| | | | |
|---|---|---|---|
| 2,119,436 | 5/1938 | Lauff | 63/4 |
| 2,540,369 | 2/1951 | Hume | 63/4 X |
| 2,714,269 | 8/1955 | Charles | 63/4 X |

*Primary Examiner*—Evan Lawrence
*Attorney, Agent, or Firm*—William H. Pavitt, Jr.

[57] ABSTRACT

A method of producing decorative lengths of shot chain involves pre-heating the chain, initally applying a primer coat, reheating the primed chain, then subjecting one side of the chain to the application of paint of one color, reheating the chain to set that application, applying a different color to the other side of the chain and then baking to anneal the paint. The chain is then clipped to desired lengths. The method may be practiced either continuously or step-by-step.

7 Claims, 1 Drawing Sheet

METHOD FOR FABRICATING DECORATIVE BEAD CHAINS

This is a division of application Ser. No. 07/425,129, filed Oct. 23, 1989.

FIELD OF THE INVENTION

This invention relates to the art of fabricating strings or chains of metal elements, and particularly shot or bead chains.

BACKGROUND OF THE INVENTION

What are usually called "shot" or "bead chains" have been known and available for purchase for many decades. Such chains normally come in an unpainted metallic condition, but are frequently painted either by drawing them through a vessel containing paint or past a paint sprayer. Such painting has usually been a one pass operation, with the result that the bead or shot chain assumes a single solid color.

In recent times, however, it has been found that even bright solid colors applied to shot or bead chains have not rendered the latter sufficiently appealing to result in widespread adoption and use of such chains. What has been found most appealing are shot or bead chains having a plurality of colors, particularly where lengths of the chain may be hung in such a manner as to permit them to turn or twist naturally upon the application of even the slightest lateral stimulus to the bead or chain. Examples of such chain pendencies could be where they are employed as earrings, curtains or hat ornaments. The problem, however, is that prior to the present invention there has been no economical and effective method for applying a plurality of colors to shot or bead chains, and particularly in such a manner that the colors do not tend to run together.

SUMMARY OF THE INVENTION

The method of the present invention may be accomplished either continuously or step-by-step. The step-by-step method may be preferred where the quantities of decorative chain do not justify the installation of expensive baking, spraying and carrier equipment.

The method of the present invention involves the steps of preheating predetermined lengths of the chain, initially applying a primer coat, followed by a reheating of the primed chain and then subjecting one side of the chain to one preselected color, immediately followed by a brief period of reheating to set the color, and then applying a different color to the other side of the chain. Optionally, paint splatters of still further colors may thereafter be applied to both sides of the chain. The thus painted chain is then baked for a sufficient period of time, e.g. 15–20 minutes to insure proper annealing of the colored paint to the metal surface of the shot or beads of the chain. Following such baking, the chain may then be clipped into desired lengths.

In one embodiment of the invention, an extended length of the chain may be resiliently suspended back and forth across a rack which could be rectangular, circular, or elliptical, which rack should be open on both sides of the thus suspended chain. Such rack should be insertable in an oven and when removed therefrom, supportable to enable the various paints to be applied to the chain in a manner hereinabove described.

Alternatively, a continuous carrier could be provided to move one or more extended lengths of chain sequentially through an oven or other heating area, and one or more painting stations and additional ovens or heating areas, and ultimately to a chain clipping position.

As a result of the application of paints to a shot or bead chain in the manner herein described when clipped into desired lengths, such lengths will appear with variegated coloring such that, if suspended by one end, the chain and any parallel lengths similarly pending may be found to twist about vertical axii with the slightest lateral disturbance of the chain or the element from which the chain may be suspended. Such turning or twisting produces an interesting, almost kaleidoscopic variegated color display. This effect has resulted in a considerable spontaneous popular demand for shot or bead chains thus colored for decorative purposes.

DESCRIPTION OF THE DRAWINGS

In the accompanying drawings.

DESCRIPTION OF THE PREFERRED EMBODIMENT

Figure 1:
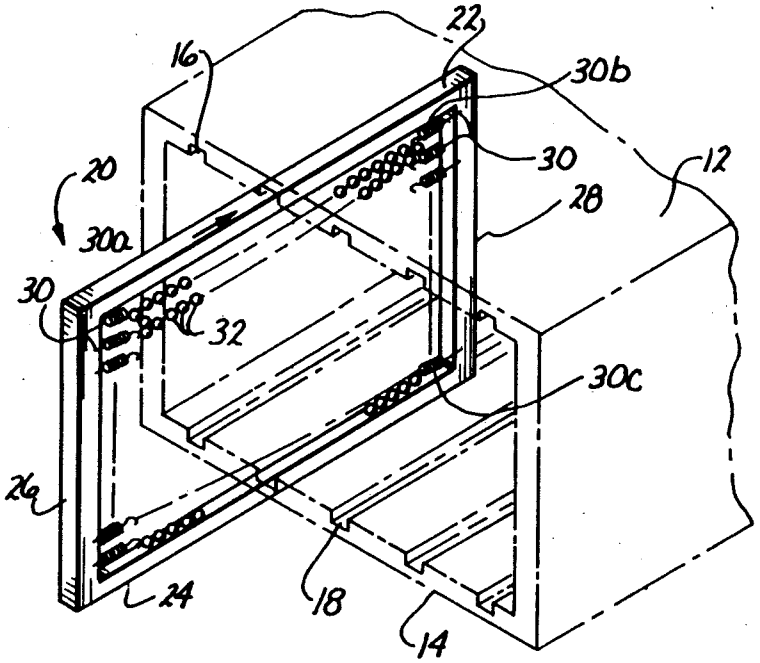
FIG. 1 is a perspective view of a rack insertable in an oven and carrying a resiliently suspended length of shot or bead chain for processing in accordance with the method of the present invention.

FIG. 1 illustrates apparatus for practicing the present invention where only limited quantitites of the finished product may be required. Such apparatus may comprise an oven 10 shown in dotted lines, the upper and lower walls 12, 14 being slotted at 16 and 18, respectively to receive a rack 20.

The rack 20 may comprise a rectangular metallic frame having top and bottom members 22, 24 connected at their ends by side members 26, 28. Inside the side members 26 and 28 are secured a plurality of hooked spring elements 30 which extend inwardly toward the opposing side member.

One end 32 of a shot or bead chain 34 is hooked on to a corner spring **30*a*, but transversely across the opening defined by the frame 20 to the hooked element 30*b* to be hooked thereon under at least slight tension. The shot chain is then brought back and forth to be hooked alternately on the remaining spring elements 30, projecting inwardly from the side members 26 and 28, until the end of the length of shot chain is reached or hooked on to the lowermost spring element 30*c***.

In practicing the process of the present invention, the frame 20 thus encompassing the tensionally suspended shot chain 34 is slipped into a pair of slots 16 and 18 in the oven and the oven door (not shown) is closed. The oven is heated to a temperature somewhere between 250 degrees to 350 degrees (preferrably closer to the latter figure) for a couple of minutes, thereby effectively preheating the shot chain to such oven temperature.

Figure 2:
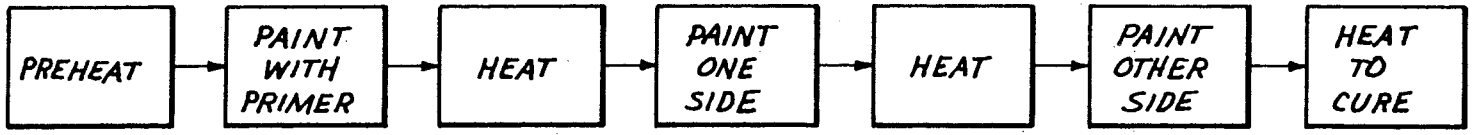
FIG. 2 is a block diagram of the steps suggested for practicing the method of the present invention.

The rack 20 with the chain 34 is then withdrawn from the oven and a coat of paint primer is sprayed or otherwise applied to both sides of the shot chain. At this point, the rack is reinserted in the oven for a few minutes to dry the primer, whereupon the rack 20 is again withdrawn from the oven and a paint of one color is applied to one side of the rack 20 and, consequently, one side of the shot chain. Again, as illustrated in FIG. 2, the rack is reinserted into the oven for a brief heating period to set the paint last applied, following which the rack is again withdrawn and paint of a different color is applied to the unpainted sides of the shot chain. Because the paint hits the chain before it has cooled from its last heating, it tends to set quickly and not run, but at this point, with both sides of the suspended shot chain now having been painted different colors, the rack may be inserted in the oven for the last time for a sufficient period to enable the paint to anneal to the metal surface. The rack may then be withdrawn from the heating oven and left to cool, at which point the painted shot chain 34 may then be unhooked from the elements 30, 30*a*, 30*b* and 30*c*, and clipped into such shorter lengths, if any, as may be desired.

Figure 4:
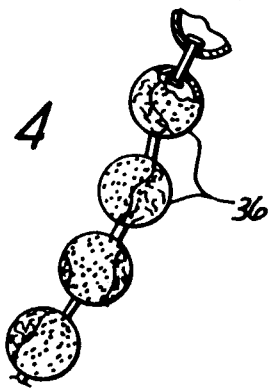
FIG. 4 illustrates the resulting variegated colored shot or bead chain.

It will also be possible, after both sides of the shot chain 34 have received their different colored coats and the latter have been sufficiently set as by heating or otherwise, to splatter still different paint colors upon one or both sides of the shot chain. It will be found that when the shot chain has been thus painted and strings of the chain are hung down, and any lateral disturbance of the chain will cause its individual balls 36 (FIG. 4) to present a color variegation which is almost kaleidoscopic in effect.

Figure 3:
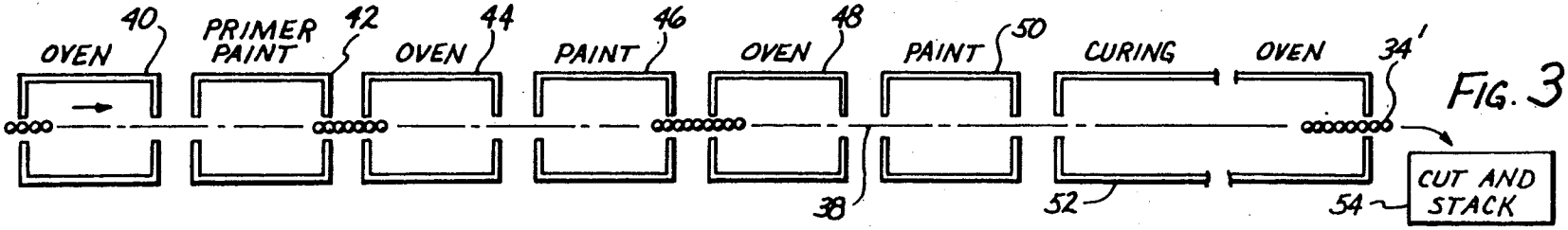
FIG. 3 is a schematic diagram of an automated apparatus for practicing the present invention.

While the method of the present invention has been described as having been accomplished by the use of the rack 20 in an oven 10, it would also be possible to set up the painting of shot chain 34 in a continuous manner as shown schematically in FIG. 3. Thus, a continuous length of shot chain 34' is moved by a continuous carrier 38, first to an oven 40, next to a paint primer station 42, a second oven 44, paint station 46, oven 48, paint station 50, and a carrying oven 5, after which the chain 34' may be deposited in a receptacle 54 for cutting and/or stacking.

While the continuous carrier method of FIG. 3 would appear to offer many advantages over the method involving moving the rack 20 in and out of the oven 10, the continuous carrier method would entail substantial expenditures in the way of the various items of equipment required for the process. Where, therefore, the production may be limited to not over a few hundred feet of chain per day, the rack and oven method may be considerably more economical.

When the chains have been painted according to either method, they may be made into interesting decorative items, such as earrings 56, shown in FIG. 5 and/or necklaces 58, shown in FIG. 6. Because of the variegation of colors which may appear on these items, particularly where they are suspended and allowed to rotate, the effect has been most interesting so that the resulting product has obtained widespread commercial appeal.

We claim:

1. The method of producing a decorative shot or bead chain, each element of which is permanently coated with a variegation of colors, said method comprising:

(a) preheating the chain to at least 250 degrees Fahrenheit for a brief period to bring the chain to such temperature;

(b) suspending the chain and, while so suspended, applying to each of at least two different areas of each shot or bead a different color paint; and (c) subjecting the thus painted chain to further heating for a sufficient period to anneal the paint to the outside surfaces of the shot or beads of the chain.

2. The method of producing a decorative shot or bead chain, each element of which is permanently coated with a variegation of colors, said method comprising:

(a) preheating the chain to at least 250 degrees Fahrenheit for a brief period of time to bring the chain to such temperature;

(b) suspending the chain and, while so suspended, applying a primer paint coat to the beads;

(c) re-heating the thus primea chain to at least 250 degrees Fahrenheit for a second period sufficient to dry the primer coat;

(d) removing the primer coated chain from the heat and applying to each of at least two different areas of each shot or bead a different colored paint; and (e) subjecting the thus painted chain to further heating for a sufficient period to anneal the paint to the outside surfaces of the shot or beads of the chain.

3. The method of producing a decorative shot or bead chain, each element of which is permanently coated with a variegation of colors, said method comprising:

(a) preheating the chain to at least 250 degrees Fahrenheit for a brief period of time to bring the chain to such temperature;

(b) suspending the chain and, while so suspended, applying a primer coat to the beads;

(c) re-heating the thus primed chain to at least 250 degrees Fahrenheit for a secnod period sufficient to dry the primer coat;

(d) removing the chain from the heat and applying to one side of the heated primed chain a paint of a first color, and re-subjecting the chain to a second reheating;

(e) removing the chain from the heat and applying to the other side of the chain a paint of a second color; and (f) subjecting the thus painted chain to further heating for a sufficient period to anneal the paint to the outside surface of the shot or beads of the chain.

4. The method as described in claim 3 wherein after step (e) and before step (f) both sides of the chain are splattered with paint of a third color.

5. The method as described in claim 1 wherein the suspension of the chain is accomplished by means of a rack having a series of resiliently disposed hooks on each side of the rack over which hooks the chain is transversely disposed in tension.

6. The method as described in claim 1 wherein, upon completion of the heating to anneal the paint, the chain is clipped to desired lengths.

7. The method as described in claim 1 wherein the steps are accomplished seriatum by a continuously moving carrier passing through heating and painting stations.

* * * * *